US007926574B2

(12) United States Patent
Mondelli et al.

(10) Patent No.: US 7,926,574 B2
(45) Date of Patent: Apr. 19, 2011

(54) FLUID ACTUATED CIRCULATING SUB

(75) Inventors: Maximiliano Mondelli, Houston, TX (US); George Krieg, Youngsville, LA (US); David Hebert, Scott, LA (US); David Robinson, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/716,990

(22) Filed: Mar. 3, 2010

(65) Prior Publication Data

US 2010/0155081 A1 Jun. 24, 2010

Related U.S. Application Data

(63) Continuation of application No. 11/811,301, filed on Jun. 8, 2007, now Pat. No. 7,766,086.

(51) Int. Cl.
*E21B 34/10* (2006.01)

(52) U.S. Cl. ..... 166/374; 166/319; 166/331

(58) Field of Classification Search ..... 166/319, 166/321, 331, 320, 374, 386
See application file for complete search history.

(56) References Cited

U.S. PATENT DOCUMENTS

| | | | | |
|---|---|---|---|---|
| 3,005,507 | A * | 10/1961 | Clark, Jr. et al. | 175/324 |
| 4,576,196 | A * | 3/1986 | Ross et al. | 166/318 |
| 5,901,796 | A * | 5/1999 | McDonald | 175/57 |
| 6,378,612 | B1 * | 4/2002 | Churchill | 166/319 |
| 6,488,092 | B1 * | 12/2002 | Schoeffler | 166/320 |
| 6,675,897 | B1 * | 1/2004 | McGarian et al. | 166/321 |
| 6,820,697 | B1 * | 11/2004 | Churchill | 166/374 |
| 2004/0231853 | A1 * | 11/2004 | Anyan et al. | 166/373 |
| 2007/0295514 | A1 * | 12/2007 | Rohde et al. | 166/386 |

FOREIGN PATENT DOCUMENTS

| | | | |
|---|---|---|---|
| EP | 0136146 | * | 4/1985 |
| EP | 1055797 | * | 11/2000 |
| GB | 2307932 | * | 6/1997 |
| GB | 2394488 | * | 4/2004 |
| WO | WO 01/06086 | * | 1/2001 |

OTHER PUBLICATIONS

Combined Search and Examination Report dated Aug. 1, 2008 for corresponding British Application No. 0808637.3.*

* cited by examiner

*Primary Examiner* — Hoang Dang
(74) *Attorney, Agent, or Firm* — Zarian Midgley & Johnson PLLC

(57) ABSTRACT

A downhole device used to divert fluid flow out of a work string into an annulus. The downhole device is activated by the movement of a plurality of pistons within the downhole device. Fluid flow through a restriction of the downhole device creates an increase in fluid pressure causing the movement of the pistons. The pistons move a flow tube between various locations within the device. In one location, the flow tube prevents fluid flow to the annulus while in another location the flow tube allows fluid flow to be diverted into the annulus. The downhole device may include a locating sleeve having a continuous j-track allowing the flow tube to be selectively retained at the various locations within the downhole device. Fluid flow through the downhole is used to cycle the device between diverting fluid flow to the annulus and forcing fluid flow down the work string.

17 Claims, 6 Drawing Sheets

FLUID ACTUATED CIRCULATING SUB

PRIORITY

This application is a continuation of U.S. Non-Provisional application Ser. No. 11/811,301, filed on Jun. 8, 2007, issued as U.S. Pat. No. 7,766,086 on Aug. 3, 2010, entitled "FLUID ACTUATED CIRCULATING SUB," which is hereby incorporated by reference in its entirety.

BACKGROUND OF THE INVENTION

1. Field of the Invention

The present invention relates generally to a downhole device that may be used to divert fluid flow out of a work string and into an annulus between the work string and tubing, casing, or the wellbore. The downhole device may be located at any point along a work string at which it may be necessary to divert the fluid flow to the annulus. The downhole device may be activated and/or deactivated by the movement of a plurality of pistons that are actuated by an increase in fluid pressure within the downhole device. Fluid flow through a restriction within the downhole device creates an increase in fluid pressure within the downhole device.

The increased fluid pressure moves the plurality of pistons downward within the downhole device. The pistons may be used to move a flow tube between various positions within the downhole device. In one position, the flow tube prevents fluid flow to the annulus while in another position the flow tube may allow fluid flow to be diverted to the annulus. The flow tube may be a longitudinal solid tube having a central bore along its entire length. A locating sleeve having a continuous j-track allows the flow tube to be selectively retained at the various locations within the downhole device. Fluid flow through the downhole device in combination with the locating sleeve may be used to cycle the device between diverting fluid flow to the annulus and preventing fluid flow to the annulus.

2. Description of the Related Art

In the oil and gas industry long tubular work strings are often used in drilling, completion, displacement, and/or work over operations. Often the work string is used to carry fluid down the well to a tool located at the end of the work string. For example, fluid may be circulated down a work string and out of a drill bit located at the end of the work string. Often drilling mud is pumped down the work string and through the drill bit. The drilling mud acts as a lubricant, but also carries the drill cuttings up the annulus around the work string to the surface.

Under certain circumstances it may be desirable to circulate fluid into the annulus surrounding the work string at a particular location. For example, the drilling mud may be entering into a porous well formation instead of properly circulating the drill cuttings to the surface. In this instance, it may be necessary to inject a sealing agent into the formation in an attempt to prevent the future loss of mud into the formation. A number of systems have been disclosed that enable the circulation of fluid to the annulus by dropping a device, such as a ball, down the work string.

U.S. Pat. No. 4,889,199 discloses a downhole device that allows annular circulation after dropping a plastic ball into the work string. The work string is broken at the surface and a plastic ball is dropped into the work string. The work string is then reconnected and fluid is pumped into the work string until the ball reaches the downhole device. The downhole device includes a shoulder that is adapted to catch the ball within the work string. Once seated on the shoulder the ball blocks the fluid flow through the work string and continual pumping of fluid causes fluid pressure to build above the seated ball. The device includes a ported sleeve that is adapted to move within the device. The sleeve is biased to an initial position by a spring. Once the force on the ball due to the fluid pressure is greater than the spring force, the ported sleeve moves within the device such that ports in the sleeve align with exterior ports in device allowing fluid to be circulated out of the work string into the annulus. When the sleeve is in its initial position the exterior ports in the work string are sealed preventing fluid flow to the annulus.

To remove the ball from the shoulder in the device, a number of smaller steel balls must be dropped into the work string, which again requires that the work string be disconnected at the surface. The number of steel balls inserted into the work string must be equal to the number of annular ports in the sleeve. The work string is then reconnected and fluid is pumped until the steel balls reach the downhole device. The steel balls are sized such that they fit within the sleeve ports blocking the fluid flow to the annulus. With the fluid flow to the annulus blocked by the steel balls and the fluid flow through the work string prevented by the plastic ball, the fluid pumped into the work string causes the fluid pressure within the work string to increase above the device until the plastic ball is deformed and pushed past the shoulder. The deformed plastic ball falls into a housing located at the bottom of the device. This allows fluid to once again flow through the work string past the device and the steel balls, which are sized smaller than the plastic ball, pass the shoulder and also are captured in the housing below the device. The sleeve is returned to its initial position due to the biasing spring until the next plastic ball is inserted into the work string.

There are a number of other systems that provide for annular flow out of the work string by dropping a device down the work string. Each of these systems requires that the work string be broken to drop a device each time that the fluid flow is to be diverted out of the work string. This process causes increases in well services costs as well as providing multiple opportunities for operator error. Further, the systems may require the use of multiple balls each cycle time the fluid flow is cycled. These balls may need to be removed from the work string or may alternatively be dropped into the well.

The use of a system that requires a device to be inserted down the work string to cycle the downhole device, such as a plastic ball, may make it difficult for operators or well service providers to accurately predict the amount of fluid pressure required to pass the ball past the shoulder within the device. The temperature within the well may cause the plastic ball to be a different size than at surface temperatures. The temperature within the well may also cause the dimensions of the shoulder to change, but because the shoulder is not comprised of plastic the change in shape may not correlate with the changes reflected in the ball. This may further make it difficult to predict the fluid pressure necessary to pass the plastic ball past the shoulder. It would thus be beneficial to provide a downhole device that may be cycled between preventing and providing annulus flow without the need of dropping a device, such as a plastic ball, down the work string.

There are other devices commercially available to divert fluid flow out of a work string to an annulus without the need to drop a device down the work string. These devices are often actuated by a pressure drop within the device that is created by increased fluid flow through a portion of the device having a restriction having a decreased flow area. This pressure drop must be sufficient to move a single component within the device, such as a piston or a sliding sleeve. However, in order to create an adequate amount of pressure to actuate the device the maximum flow area through the restriction is severely limited. Generally the current commercially offered diverting devices have a maximum diameter of ¾ inches through the restriction. Thus, it would be beneficial to provide a downhole device that did not require such a large decrease in flow area in order to actuate the device as this would allow a larger minimum flow area.

To divert fluid out of a work string, current systems generally require the alignment of ports of an inner sleeve or similar structure with the external ports in the housing of the device. The alignment of the inner ports with outer ports to allow the device to divert fluid to the annulus increases the complexity of the device. These types of devices may be susceptible to seal failure or inadequate flow if the ports are misaligned. It would be beneficial to provide a device that may divert fluid flow out of a work string without the need to align inner flow ports with external flow ports in order to divert fluid flow to the annulus.

In light of the foregoing, it would be desirable to provide a downhole device that has multiple pistons upon which an increase pressure may act to activate the device. It would be desirable to provide a downhole device that may be cycled between diverting and non-diverting modes, the downhole device having a larger flow bore. It would also be desirable to provide a downhole device that does not need to align the ports of an inner body with ports in an outer housing to divert flow out of a work string. It would be desirable to provide a downhole device that is actuated by an increase in fluid pressure due to fluid flow through a restriction, wherein multiple pistons were used to increase the inner diameter of the restriction. It would further be desirable to provide a downhole device for diverting fluid flow out of a work string that includes a secondary sliding sleeve that may be used to protect sealing elements. It would be beneficial to provide a downhole device that may be used to divert flow out of a work string having a minimum flow diameter of 1¾ inches.

The present invention is directed to overcoming, or at least reducing the effects of one or more of the issues set forth above.

SUMMARY OF THE INVENTION

The object of the present disclosure is to provide a downhole device and method to selectively divert fluid flow out of a work string to an annulus.

One embodiment is an apparatus for diverting fluid flow out of a work string that includes a top sub connected to the work string and connected to a piston housing, the top sub having an upper end, a lower end, and a central bore. The piston housing having an upper end, a lower end, and a central bore in communication with the central bore of the top sub. The piston housing including an upper piston, a middle piston, and a lower piston each being movable within the central bore of the piston housing.

The apparatus further includes a locating sleeve having a j-track positioned within the piston housing and a locating pin wherein a first end of the pin is connected to the piston housing and a second end is positioned within the continuous j-track. The j-track may be a continuous j-track about the locating sleeve. The apparatus includes a spring housing that houses a spring, the housing having an upper end, a lower end, and a central bore in communication with the central bore of the piston housing. The upper end of the spring housing is connected to the piston housing. The lower end of the spring housing is connected to a ported housing having an upper end, a lower end, a central bore in communication with the central bore of the spring housing. The ported housing includes a plurality of ports through the housing that are in communication with an annulus. A lower sub having a central bore is connected to the ported housing, the lower sub also being connected to a portion of a work string.

The apparatus includes a flow tube that is located within the central bore of the piston housing. The flow tube is adapted to sealingly slide within the central bores of the piston housing, the spring housing, and the ported housing and being adapted so that the movement of the pistons causes the flow tube to move within the apparatus. The flow tube includes a flow restriction area, wherein fluid flow through the flow restriction area increases the pressure within the downhole device. The increase in pressure moves the pistons towards the lower end of the piston housing moving the flow tube towards the lower sub until the locating pin reaches a shoulder of the continuous j-track. The shoulder of the continuous j-track may be located so that the flow tube is positioned to prevent fluid flow through the plurality of ports of the ported housing. The continuous j-track may include a second shoulder that is location so that the flow tube is positioned to allow fluid flow through the plurality of ports of the ported housing.

The apparatus may also include a sliding sleeve positioned within the central bore of the ported housing between the plurality of ports and the lower sub. The sliding sleeve may be adapted to sealingly slide with the central bore of the ported housing from a first position to a second position. In the first position, a sealing element is positioned between the sliding sleeve and the ported housing. The apparatus may include a spring positioned within the ported housing to bias the sliding sleeve to its first position.

The use of a plurality of pistons may allow the use of smaller restriction area (i.e. the restriction having a larger bore) than prior downhole diverting devices. The flow restriction area may have an inner diameter of at least 1½ inches or may have an inner diameter of at least 1¾ inches. Typical prior diverting devices typically have a restriction area having a diameter ¾ inches or less. Likewise, the flow restriction area may have an area that is at least 1.75 square inches or that is at least 2.40 square inches.

One embodiment is an apparatus for diverting fluid flow out of a work string that includes a housing having an internal bore, an upper end, a lower end, and at least one exterior port that is in communication with the internal bore and an annulus. The apparatus also includes a flow tube that is positioned within the internal bore of the housing. The flow tube is adapted to sealingly slide within the internal bore of the housing between a position that allows fluid flow through the at least one exterior port of the housing and a position that prevents fluid flow through the at least one exterior port of the housing. The flow tube may be a solid longitudinal tube having a central bore along its entire length. The apparatus further includes a plurality of pistons that are positioned within the internal bore of the housing and a spring that is biased to position the flow tube to allow fluid flow through the at least one exterior port. The plurality of pistons may be adapted to move down their respective piston housings.

A locating sleeve having a continuous j-track is positioned on the flow tube and thus moves with the flow tube along the internal bore of the housing, but the locating sleeve is adapted so that it may rotate about the flow tube. The exterior end of a pin is connected to the housing such that the interior end of the pin is positioned within the j-track of the locating sleeve. A restriction within the internal bore of the housing creates an increase in pressure in the housing as fluid flows through the restriction. The increase in pressure moves the plurality of pistons within the internal bore of the housing moving the flow tube to the position that prevents fluid flow through the at least one exterior port of the housing. Alternatively, the apparatus may be configured such that the plurality of pistons move the flow tube to the position that allows the fluid flow through the at least one exterior port of the housing.

The continuous j-track includes a plurality of shoulders. The increase and reduction of pressure within the housing may be used to move the plurality of pistons within the housing. The movement of the pistons also causes the rotation of locating sleeve with the continuous j-track. The rotation of the locating sleeve causes the movement of the track along the pin until it reaches a shoulder. Shoulders are located along the j-track to position the flow tube in a position to prevent or allow fluid flow through the at least one exterior port. The shoulders may be adapted to retain the flow tube in a specified position until the pressure within the apparatus has been cycled (i.e. increased, reduced, and then increased again).

One embodiment is a method to cycle a downhole device to divert fluid flow out of a work string. The method includes pumping fluid into a downhole device that is connected to a work string. The downhole device includes a restriction and at least one exterior port through which fluid may be diverted out of the work string. Fluid flows past the restriction increasing the fluid pressure within the downhole device. The method includes moving an upper piston from an initial position to a second position within the downhole device, moving a middle piston from an initial position to a second position within the downhole device, and moving a lower piston from an initial position to a second position within the downhole device. The movement of the pistons causes the flow tube to move from an initial position allowing fluid flow through the at least one exterior port to a position preventing fluid flow through the at least one exterior port. The method also includes rotating a locating sleeve to a first orientation. The locating sleeve rotates about the flow tube.

The method may further include reducing the pressure to rotate the locating sleeve to a second orientation within the downhole device. The second orientation retaining the flow tube in a position that prevents fluid flow through the at least one exterior port. The method may further include increasing the pressure within the downhole device to rotate the locating sleeve to a third orientation so that the flow tube allows fluid flow through the at least one exterior port.

The method may further include again reducing the pressure to rotate the locating sleeve to a fourth orientation. The fourth orientation retaining the flow tube in a position that allows fluid flow through the at least one exterior port.

An apparatus for diverting fluid flow out of a work string that includes a housing having a central bore, an upper end, a lower end, and at least one fluid port through the housing. The at least one fluid port in communication with the central bore and an annulus. The apparatus having a plurality of pistons within the central bore of the housing, wherein an increase in pressure moves the pistons within the central bore of the housing from an initial position to a second position. The apparatus further includes means for increasing the pressure within the central bore of the housing and means for preventing fluid communication between the central bore of the housing and the annulus when the plurality of pistons are in the second position. The means for increasing the pressure within the central bore being a restriction within the apparatus that may increase pressure due to fluid flow through the apparatus. The apparatus further includes means for selectively positioning the means for preventing fluid communication between the central bore of the housing. The means for selectively positioning may include a locating sleeve having a continuous j-track, a cam device, or other indexing mechanisms as would be appreciated by one of ordinary skill in the art having the benefit of this disclosure.

Figure 1:
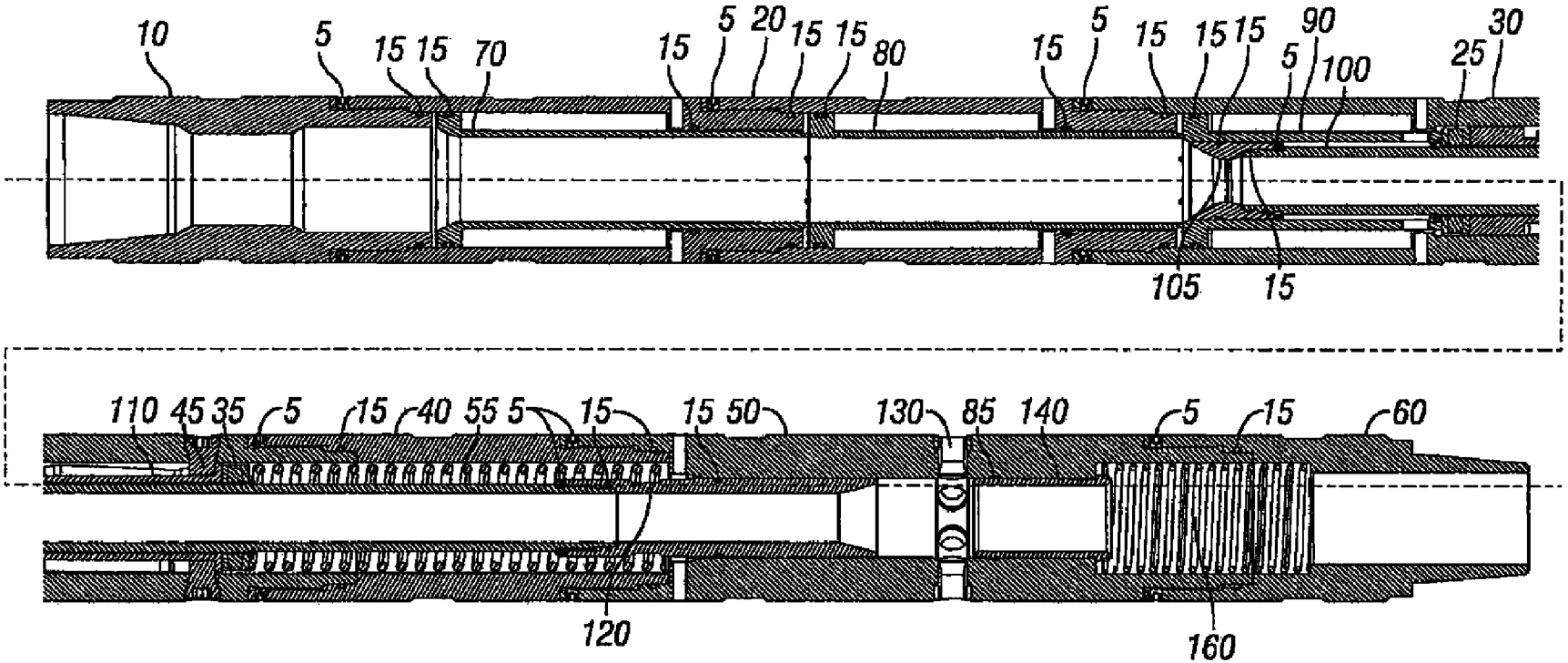
FIG. 1 shows one embodiment of the present disclosure of a downhole device that may be used to divert fluid flow out of a work string.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in a downhole device and method of using the device to diverting fluid flow out of a work string. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments of the invention will become apparent from consideration of the following description and drawings.

FIG. 1 shows one embodiment a downhole device that may be used to divert fluid flow out of a work string. The device includes a piston housing 20 that is connected to a top sub 10 on one end and connected to a lower piston housing 30 on the other end. Fasteners 5, such as hex fasteners, may be used to connect the various components of the device together as would be appreciated by one of ordinary skill in the art. The device also includes sealing elements 15, such as o-rings, that may be used to prevent fluid from escaping from the connection points between the various components of the device as would be appreciated by one of ordinary skill in the art.

The upper end of the top sub 10 may be used to connect the downhole device to a work string (not shown). The lower piston housing 30 is connected to a spring housing 40 containing a spring 55. The lower end of the spring housing 40 is connected to a ported housing 50, which is also connected to a bottom sub 60. The lower end of the bottom sub 60 may be used to connect the downhole device to a work string (not shown). The configuration and shape of the various components of the downhole device are only shown for illustrative purposes only. The downhole device may be configured as shown or alternatively some of the components may be integrated into a single housing as would be appreciated by one of ordinary skill in the art having the benefit of this disclosure.

The downhole device of FIG. 1 may be used to circulate fluid out of the work string through a plurality of external ports 130 in the ported housing 50. The ported housing 50 as shown includes four external ports 130 located radially around the housing, but the number and configuration of the external ports 130 may be varied as would be appreciated by one of ordinary skill in the art. A flow tube 100 is positioned within the central bore of the device and may be moved into a position that prevents fluid from circulating out of the work string through the external ports 130. The flow tube 100 is adapted to sealingly slide within the central bores of the lower piston housing 30, the spring housing 40, and the ported housing 50. The flow tube 100 includes a restriction 105 located at the top end of the flow tube 100 that creates an increase in pressure above the flow tube 100 as the rate of fluid flowing through the downhole device also increases. The flow tube 100 is a solid longitudinal tube having a central bore along its entire length. The absence of flow ports in the flow tube decreases the complexity of the device. The disclosed downhole device does not require the alignment of ports of a sleeve or flow tube with external ports through a housing to allow the device to divert fluid into the annulus.

The increased pressure from fluid flow through the restriction is exerted on an upper piston 70, a middle piston 80, and a lower piston 90 located in the piston housing 20 or the lower piston housing 30. The increased pressure causes the pistons to move down the housings also moving the flow tube 100 within the downhole device. A flow tube extension 120 is attached to the end of the flow tube 100. When the pistons have reached the end of their strokes the flow tube extension 120 blocks the external ports 130 preventing fluid from being diverted out of the work string. The flow tube 100 is used to block the external ports 130 and thus, prevent the diversion of fluid out of the work string rather than aligning a set of ports to divert flow out of the work string. While the embodiment shown in FIG. 1 includes a flow tube extension 120 connected to the flow tube 100, the flow tube 100 could be adapted to block the external ports 130 without an extension as would be appreciated by one of ordinary skill in the art having the benefit of this disclosure.

The ported housing 50 includes a seal 15 to prevent the flow of fluid between the flow tube extension 120 and the ported housing 50 when the flow tube 100 has been moved into position to prevent fluid flow out of the external ports 130. The ported housing 50 includes a secondary sliding sleeve 140 that protects this seal 85 when the flow tube 100 is in its position shown in FIG. 1, which allows fluid to be diverted out of the external ports 130. When the flow tube is moved down the device the flow tube extension 120 pushes the secondary sleeve 140 from a first protective position a second position located towards the bottom sub 60. A spring 160 located within the bottom sub 60 is positioned to bias the secondary sleeve 140 to the first protective position shown in FIG. 1.

The downhole device includes a locating sleeve 110 having a continuous j-track 115 (shown in FIG. 6) that is attached to the outside of the flow tube 100. The locating sleeve 110 is adapted to rotate about the flow tube 100 and also move down the bore of the downhole device when the flow tube 100 is moved by the pistons 70, 80, 90. A locating pin 45 is connected to the lower piston housing 30 and the pin 45 extends into the continuous j-track 115 of the locating sleeve 110. As the locating sleeve 110 rotates about the flow tube the locating pin 45 travels along the continuous j-track 115 and stopping at various shoulders in the track that are adapted to selectively retain the flow tube 100 at various positions within the bore of the downhole device. The operation of the locating pin 45 in the continuous j-track is discussed in more detail below with respect to FIG. 6. The downhole device may include an upper bushing 25 and a lower bushing 35 that aid in the rotation of the locating sleeve 110 with respect to the flow tube 100.

Figure 2:
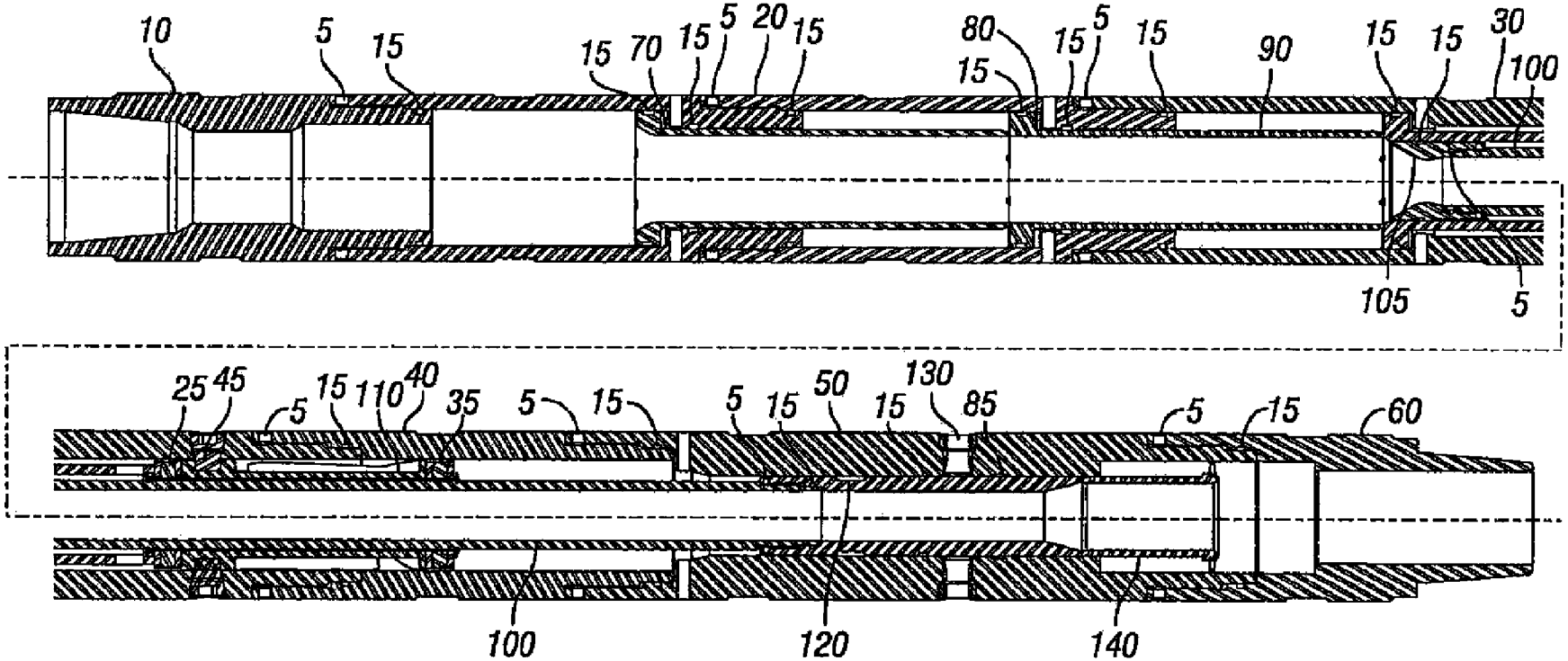
FIG. 2 shows the flow tube of the downhole device in a location that prevents fluid flow from being diverted out of the device into the annulus.
Figure 3:
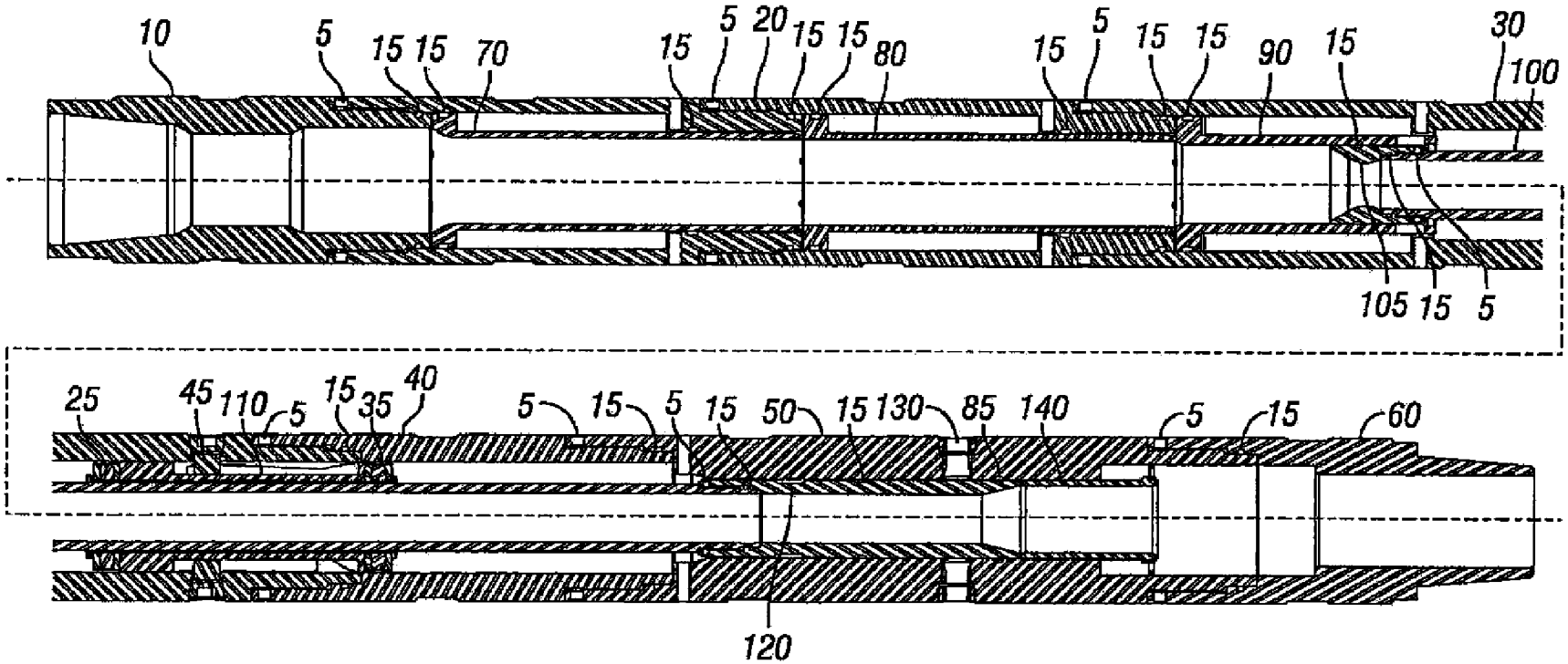
FIG. 3 shows the flow tube of the downhole device in its lower position within the bore of the device preventing the fluid flow from being diverted out of the device into the annulus.

FIG. 2 shows the flow tube 100 of the downhole device in the most downward position. Fluid is pumped down the work string creating an increased pressure within the downhole device due to flow through the restriction 105 causing the pistons 70, 80, 90 and the flow tube 100 to completely compress the spring 55. The flow tube 100 is positioned at its lowest position within the downhole device. When fluid is pumped down the device compressing the spring 55 in this manner the locating pin 45 will be located at a first shoulder (117 in FIG. 6) to position the flow tube at its lowest position. At its lowest position within the device, the flow tube 100 prevents fluid from being diverted to the annulus through the external ports 130. Once the pumps are shut off causing the fluid flow through the downhole device to decrease, the locating sleeve 110 will move up the bore and rotate into the next shoulder due to the upward force from the compressed spring 55. This allows the flow tube 100 to move up the bore of the apparatus a short distance as shown in FIG. 3. The rotation of the locating sleeve 110 positions the locating pin 45 at a second shoulder (116 of FIG. 6) of the continuous j-track 115 of the locating sleeve 110. The second shoulder is located along the locating sleeve 110 to retain the flow tube 100 in a position that continues to block the external ports 130 thus, preventing fluid from being diverted out of the work string as shown in FIG. 3.

Figure 4:
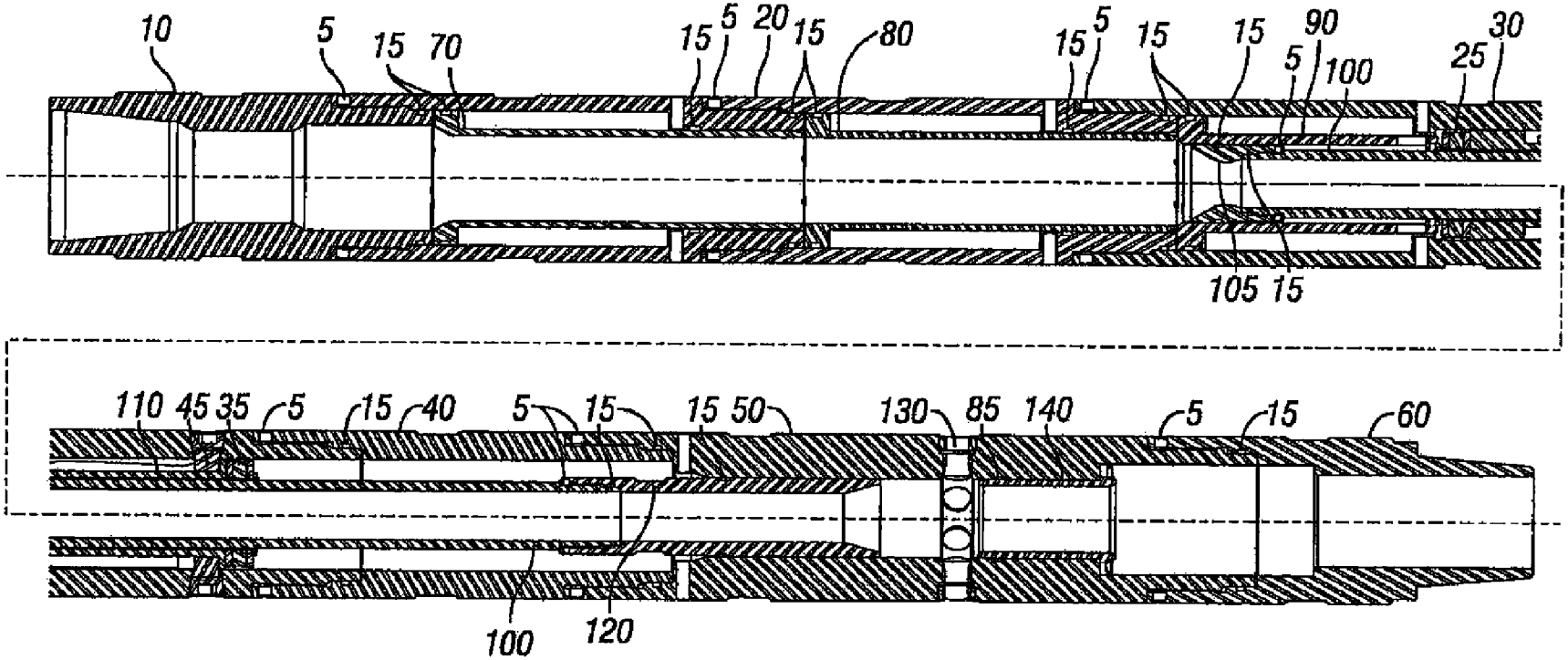
FIG. 4 shows the flow tube of the downhole device in a location that allows fluid flow to be diverted out of the device into the annulus.

When it is desired to circulate fluid out of the work string a pump may be turned on to create a pressure drop within the downhole device due to flow through the restriction 105 as discussed above. The increased pressure moves the locating sleeve 110 downward rotating the locating pin 45 out of the second shoulder of the continuous j-track 115 to a third shoulder (114 of FIG. 6). The third shoulder is located along the locating sleeve 110 to position the flow tube 100 within the downhole device to continue blocking the external ports 130. When the flow is decreased within the device compressed spring 55 will move the locating sleeve 110 upward causing the locating sleeve 110 to rotate and position the locating pin 45 at a fourth shoulder (corresponding to 113 of FIG. 6) located to position the end of the flow tube 100 above the external ports 130 as shown in FIG. 4. The fourth shoulder is adapted to retain the flow tube 100 at this location within the device, which allows fluid to be diverted into the annulus until the fluid flow is increased though the downhole device. A constant flow of fluid may be diverted to the annulus without indexing the locating sleeve.

Figure 5:
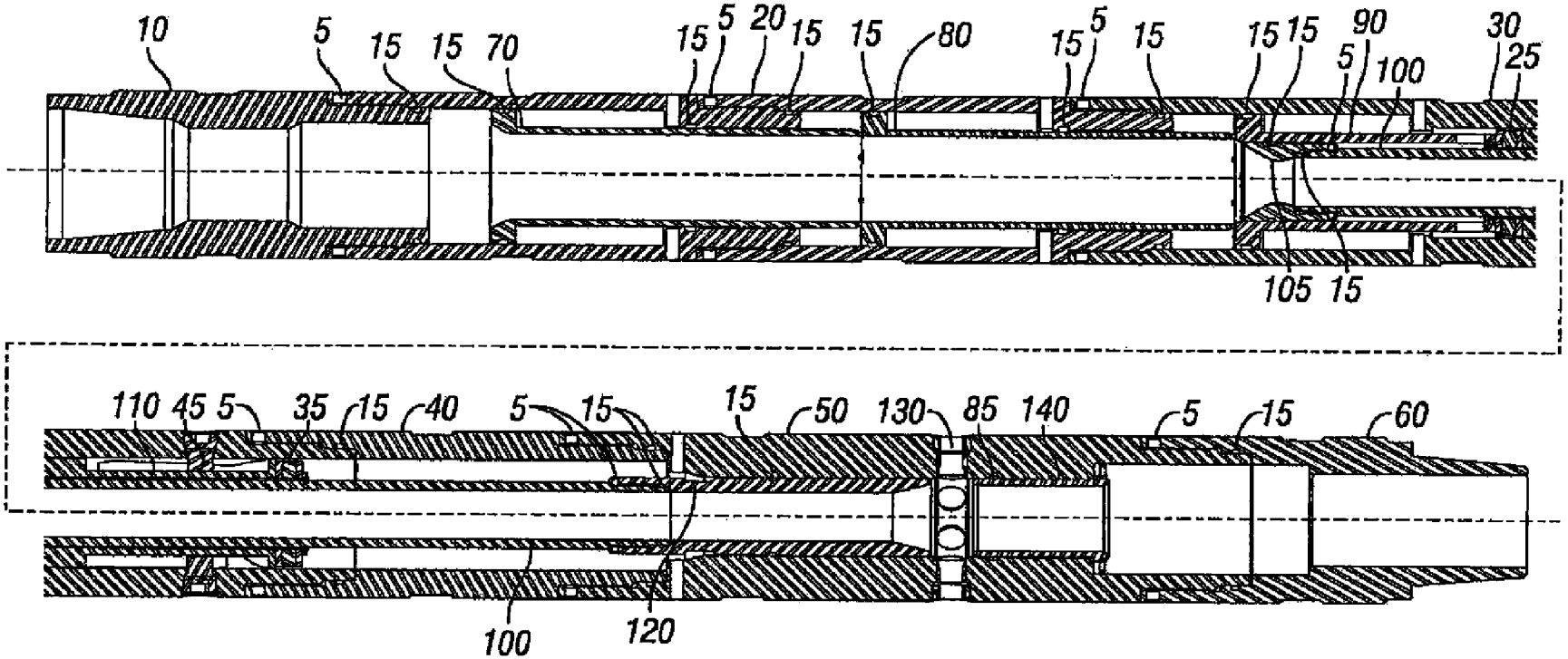
FIG. 5 shows the flow tube of the downhole device in a location while fluid is being pumped through the device that allows fluid flow to be diverted out of the device into the annulus.

Upon an increase in pressure, the locating sleeve 110 will move downwards rotating the locating pin 45 out of the fourth shoulder of the continuous j-track 115 causing the locating pin 45 to engage a fifth shoulder (112 of FIG. 6) of the continuous j-track 115. The fifth shoulder is adapted along the locating sleeve 110 to hold the end of the flow tube 100 above the external ports 130 allowing fluid to be still diverted into the annulus as shown in FIG. 5. A reduction in the flow through the downhole device will decrease the pressure and the compressed spring 55 will cause the locating sleeve 110 to move upwards rotating the locating pin 45 to move out of the fifth shoulder and engage a sixth shoulder (111 of FIG. 6) of the continuous j-track 115 that holds the flow tube 100 in the open position. However, the next increase in pressure will cause the locating sleeve to again rotate positioning the locating pin again at the first shoulder to index the flow tube to the closed position as shown in FIG. 3.

Figure 6:
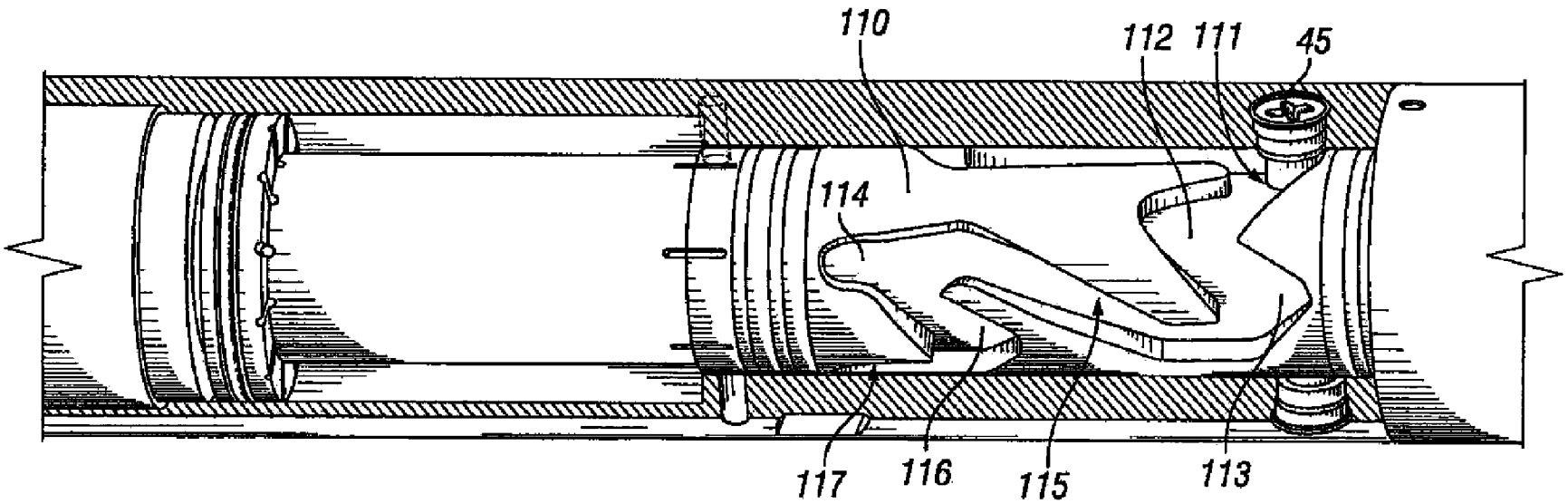
FIG. 6 shows one embodiment of a locating sleeve having a continuous j-track that may be used to index the flow tube of the downhole device at various locations within the bore of the device.

FIG. 6 shows the locating pin 45 positioned at a shoulder 111 of the continuous j-track 115 at the lower end of the locating sleeve 110. When the locating pin 45 is located in this shoulder 111 the flow tube 100 is positioned at its upper most location within the bore of the downhole device such that allowed fluid flow through the external ports 130 to the annulus. Each time the pressure within the downhole device is increased the movement of the flow tube 100 causes the locating sleeve 110 to rotate indexing the locating pin 45 to a different shoulder along the continuous j-track 115. Likewise, when the pressure within the downhole device is reduced, the uncompression of the spring 55 causes the rotation of the locating sleeve 110 indexing the locating pin 45 to a different shoulder along the continuous j-track 115.

Rotation of the locating sleeve 110 due to downward movement of the flow tube 100 and locating sleeve 110 causes the locating pin to engage one of the upper shoulders 112, 114, 117 of the continuous j-track 115 while the rotation of the locating sleeve because of the upward movement of the flow tube due to the compressed spring 55 causes the locating pin to engage one of the lower shoulders 111, 113, 116. The flow tube 100 prevents fluid flow through the external ports 130 and into the annulus when the locating pin is positioned in one of the shoulders 114, 116, 117 located at the upper end of the locating sleeve 110. The flow tube 100 allows fluid to be diverted out of the downhole device into the annulus when the locating pin 45 is located in one of the shoulders 111, 112, 113 at the lower end of the locating sleeve 110. The continuous j-track may be repeated around the sleeve as shown in FIG. 6. The indexing mechanism shown in FIG. 6 is for illustrative purposes only and various mechanisms may be used to index the flow tube within the downhole device as would be appreciated by one of ordinary skill in the art having the benefit of this disclosure.

Although various embodiments have been shown and described, the invention is not so limited and will be understood to include all such modifications and variations as would be apparent to one skilled in the art.

What is claimed is:

1. An apparatus for diverting fluid flow out of a work string, the apparatus comprising:

a housing having a central bore and at least one fluid port through the housing, the at least one fluid port communicating the central bore with an annulus;

an upper piston operable for movement within the housing, wherein an increase in pressure moves the upper piston along the housing from an initial position to a second position;

a middle piston operable for movement within the housing;

a lower piston operable for movement within the housing, wherein the increase in pressure also moves the middle and lower pistons along the housing from the initial position to the second position; and a flow tube configured to prevent fluid communication between the central bore and the annulus in response to movement of the upper, middle, and lower pistons, wherein fluid communication between the central bore and the annulus, via the at least one fluid port, is achieved without the use of a port along the flow tube.

2. An apparatus as defined in claim 1, the apparatus further comprising a flow restriction area located along the flow tube, wherein fluid flow through the flow restriction area provides the increase in pressure necessary to move the upper, middle, and lower pistons.

3. An apparatus as defined in claim 1, the apparatus further comprising:

a locating sleeve positioned along the housing;

a j-track positioned along the locating sleeve; and a locating pin connected to the housing, the locating pin having an end which extends into the j-track, wherein the locating pin travels along the j-track in order to selectively retain the flow tube at various positions along the housing.

4. An apparatus as defined in claim 2, wherein the flow restriction area has an inner flow diameter of at least 1½ inches.

5. An apparatus as defined in claim 1, wherein the flow tube is a solid longitudinal tube having a central bore therethrough.

6. An apparatus as defined in claim 1, the apparatus further comprising:

a seal located within the central bore, the seal being adjacent the at least one fluid port;

a secondary sleeve operable to protect the seal while the flow tube is in the initial position, the secondary sleeve being moveable from a protective position to an unprotected position; and a spring operable to bias the secondary sleeve to the protect position.

7. A method for diverting fluid flow out of a work string, the method comprising the steps of:

(a) pumping fluid into a downhole device having at least one exterior port through which fluid may be diverted out of the work string;

(b) pumping the fluid through a restriction along the downhole device, thereby increasing the pressure within the downhole device;

(c) moving a flow tube from an initial position that allows fluid flow through the at least one exterior port to a position that prevents fluid flow through the at least one exterior port, the movement being in response to the pressure increase, wherein step (c) further comprises the steps of:

moving an upper piston from an initial position to a second position within the downhole device;

moving a middle piston from an initial position to a second position within the downhole device; and moving a lower piston from an initial position to a second position within the downhole device, wherein the movement of the upper piston, middle piston, and lower piston moves the flow tube from the initial position that allows fluid flow through the at least one exterior port to the position that prevents fluid flow through the at least one exterior port; and (d) reducing the pressure along the downhole device, thereby moving the flow tube back to the initial position that allows fluid flow through the at least one exterior port, wherein the fluid flow communicates through the at least one exterior port into an annulus without the use of a port along the flow tube.

8. A method as defined in claim 7, wherein the movement of step (d) is accomplished via the use of a spring.

9. A method as defined in claim 7, wherein step (b) further comprises the step of providing the restriction with an inner flow diameter of at least 1½ inches.

10. A method as defined in claim 7, the method further comprising the step of providing the flow tube as a solid longitudinal tube having a central bore therethrough.

11. A method as defined in claim 7, wherein step (c) further comprises the steps of:

moving a secondary sleeve in response to the movement of the flow tube, the movement of the secondary sleeve uncovering a seal; and utilizing the seal to seal between the flow tube and a housing of the downhole device.

12. A method for diverting fluid flow out of a work string, the method comprising the steps of:

(a) pumping fluid into a downhole device having at least one exterior port through which fluid may be diverted out of the work string;

(b) moving a flow tube from an initial position that allows fluid flow through the at least one exterior port to a position that prevents fluid flow through the at least one exterior port, wherein step (b) further comprises the steps of:

moving an upper piston from an initial position to a second position within the downhole device;

moving a middle piston from an initial position to a second position within the downhole device; and moving a lower piston from an initial position to a second position within the downhole device, wherein the movement of the upper piston, middle piston, and lower piston moves the flow tube from the initial position that allows fluid flow through the at least one exterior port to the position that prevents fluid flow through the at least one exterior port; and (c) allowing fluid flow through the at least one exterior port without the use of a port along the flow tube.

13. A method as defined in claim 12, wherein the method further comprises the step of moving the flow tube back to the initial position that allows fluid flow through the at least one exterior port, the movements between the positions being accomplished by increasing or decreasing the pressure within the downhole device.

14. An apparatus for diverting fluid flow out of a work string, the apparatus comprising:

a housing having a central bore and at least one fluid port through the housing, the at least one fluid port communicating the central bore with an annulus;

a piston operable for movement within the housing, wherein an increase in pressure moves the piston along the housing from an initial position to a second position;

a flow tube configured to prevent fluid communication between the central bore and the annulus in response to movement of the piston, wherein fluid communication between the central bore and the annulus, via the at least one fluid port, is achieved without the use of a port along the flow tube;

a locating sleeve positioned along the housing;

a j-track positioned along the locating sleeve; and a locating pin connected to the housing, the locating pin having an end which extends into the j-track, wherein the locating pin travels along the j-track in order to selectively retain the flow tube at various positions along the housing.

15. An apparatus for diverting fluid flow out of a work string, the apparatus comprising:

a housing having a central bore and at least one fluid port through the housing, the at least one fluid port communicating the central bore with an annulus;

a piston operable for movement within the housing, wherein an increase in pressure moves the piston along the housing from an initial position to a second position;

a flow tube configured to prevent fluid communication between the central bore and the annulus in response to movement of the piston, wherein fluid communication between the central bore and the annulus, via the at least one fluid port, is achieved without the use of a port along the flow tube;

a seal located within the central bore, the seal being adjacent the at least one fluid port;

a secondary sleeve operable to protect the seal while the flow tube is in the initial position, the secondary sleeve being moveable from a protective position to an unprotected position; and a spring operable to bias the secondary sleeve to the protect position.

16. A method for diverting fluid flow out of a work string, the method comprising the steps of:

(a) pumping fluid into a downhole device having at least one exterior port through which fluid may be diverted out of the work string;

(b) pumping the fluid through a restriction along the downhole device, thereby increasing the pressure within the downhole device;

(c) moving a flow tube from an initial position that allows fluid flow through the at least one exterior port to a position that prevents fluid flow through the at least one exterior port, the movement being in response to the pressure increase, wherein step (c) further comprises the steps of:

moving a secondary sleeve in response to the movement of the flow tube, the movement of the secondary sleeve uncovering a seal; and utilizing the seal to seal between the flow tube and a housing of the downhole device; and (d) reducing the pressure along the downhole device, thereby moving the flow tube back to the initial position that allows fluid flow through the at least one exterior port, wherein the fluid flow communicates through the at least one exterior port into an annulus without the use of a port along the flow tube.

17. A method for diverting fluid flow out of a work string, the method comprising the steps of:

(a) pumping fluid into a downhole device having at least one exterior port through which fluid may be diverted out of the work string;

(b) moving a flow tube from an initial position that allows fluid flow through the at least one exterior port to a position that prevents fluid flow through the at least one exterior port, wherein step (b) further comprises the steps of:

moving a secondary sleeve in response to the movement of the flow tube, the movement of the secondary sleeve uncovering a seal; and utilizing the seal to seal between the flow tube and a housing of the downhole device; and (c) allowing fluid flow through the at least one exterior port without the use of a port along the flow tube.

* * * * *